United States Patent [19]

Iura

[11] Patent Number: 4,858,261

[45] **Date of Patent: * Aug. 22, 1989**

[54] MOVABLE BED VEHICLE

[75] Inventor: Tadashi Iura, Ehime, Japan

[73] Assignee: Hoxan Corporation, Chuo-ku Sapporo, Japan

[ * ] Notice: The portion of the term of this patent subsequent to Jul. 22, 2004 has been disclaimed.

[21] Appl. No.: 102,607

[22] Filed: Sep. 30, 1987

Related U.S. Application Data

[63] Continuation of Ser. No. 590,745, Mar. 19, 1984, abandoned.

[51] Int. Cl.[4] ..... A61G 7/08

[52] U.S. Cl. ..... 5/81 B; 5/81 R; 5/82 B

[58] Field of Search ..... 5/81 B, 81 R, 82 B, 5/86, 82 R

[56] References Cited

U.S. PATENT DOCUMENTS

| | | | |
|---|---|---|---|
| Re. 28,056 | 6/1974 | Stevens | 5/82 |
| 2,528,048 | 10/1950 | Gilleland | 5/86 |
| 2,630,583 | 3/1953 | Gilleland | 5/81 R |
| 2,668,301 | 2/1954 | Brouillette | 5/86 |
| 2,786,523 | 1/1974 | Sele | 5/86 |
| 2,905,952 | 9/1959 | Reichert et al. | 5/86 |
| 3,015,114 | 1/1962 | Slib | 5/86 |
| 3,088,020 | 7/1963 | Garfield et al. | 5/81 B |
| 3,493,479 | 2/1970 | Koll et al. | 5/86 |
| 3,541,617 | 11/1970 | Clanan | 5/86 |
| 3,765,037 | 10/1973 | Dunkin | 5/86 |
| 3,967,328 | 7/1976 | Cox | 5/81 R |
| 4,077,073 | 3/1978 | Koll et al. | 5/81 R |
| 4,087,873 | 5/1978 | Ohkawa | 5/86 |
| 4,259,756 | 4/1981 | Face | 5/86 |
| 4,262,375 | 4/1981 | Lilienthal | 5/81 B |

*Primary Examiner*—Richard E. Moore
*Assistant Examiner*—Vinh Luong
*Attorney, Agent, or Firm*—Fleit, Jacobson, Cohn & Price

[57] ABSTRACT

A movable bed vehicle which has a truck having rolling wheels with low centroid, a post erected at the longitudinal intermediate position at one side of lateral direction of the vehicle, an elevator provided adjustably at the post in such an elevationally movable manner, a bed frame having a longitudinal length at the elevator and a bend mattress, and mounted directly above the truck, a normally and reverely rotatably rotational shaft provided along the longitudinal direction of the bed frame for rotating by a handle the bed frame in a space of elevator side, a plurality of strips provided at a plurality of longitudinal positions of the shaft for towing the movable sheet on the mattress to the elevator side by normally taking up the strips, and another strips for towing the movable sheet until the elevator is extended to the opposite side from the mattress by the revere rotation. Thus, a physically handicapped patient who cannot move on the bed can be shifted at his sleeping position by one nurse or attendant, shifted on the bed mattress of the movable bed vehicle merely by operating the handle in an extremely simple and rapid work.

2 Claims, 8 Drawing Sheets

MOVABLE BED VEHICLE

This is a continuation of application Ser. No. 590,745 filed Mar. 19, 1984, abandoned

BACKGROUND OF THE INVENTION

This invention relates to a movable bed vehicle which can transfer a physically handicapped patient or person laid on a bed from the bed to an arbitrary position and again transfer him to the bed.

A typical conventional movable bed vehicle of this type is constructed to transfer a physically handicapped patient or person laid on a bed mattress by mooring the vehicle to the side of a bed and raising him several nurses above the mattress. Thus, the nurses tend to hurt their waists, and the patient is anxious for that and frequently hesitates to transfer from the bed to other place even if he wishes to transfer.

SUMMARY OF THE INVENTION

Accordingly, a primary object of this invention is to provide a movable bed vehicle which can rapidly transfer a patient laid on a movable sheet onto a bed mattress and readily and rapidly transfer a physically handicapped patient or person even by a nurse or an attendant by providing a bed frame provided with a bed mattress in an elevationally movable manner at posts stood from suitable positions of a truck in a structure that the mattress can be moored to the vicinity of him laid on the bed, arranging the movable sheet extensible toward a predetermined direction from the mattress on the bed mattress.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

The present invention will now be described in more detail with reference to the accompanying drawings.

Figure 1:
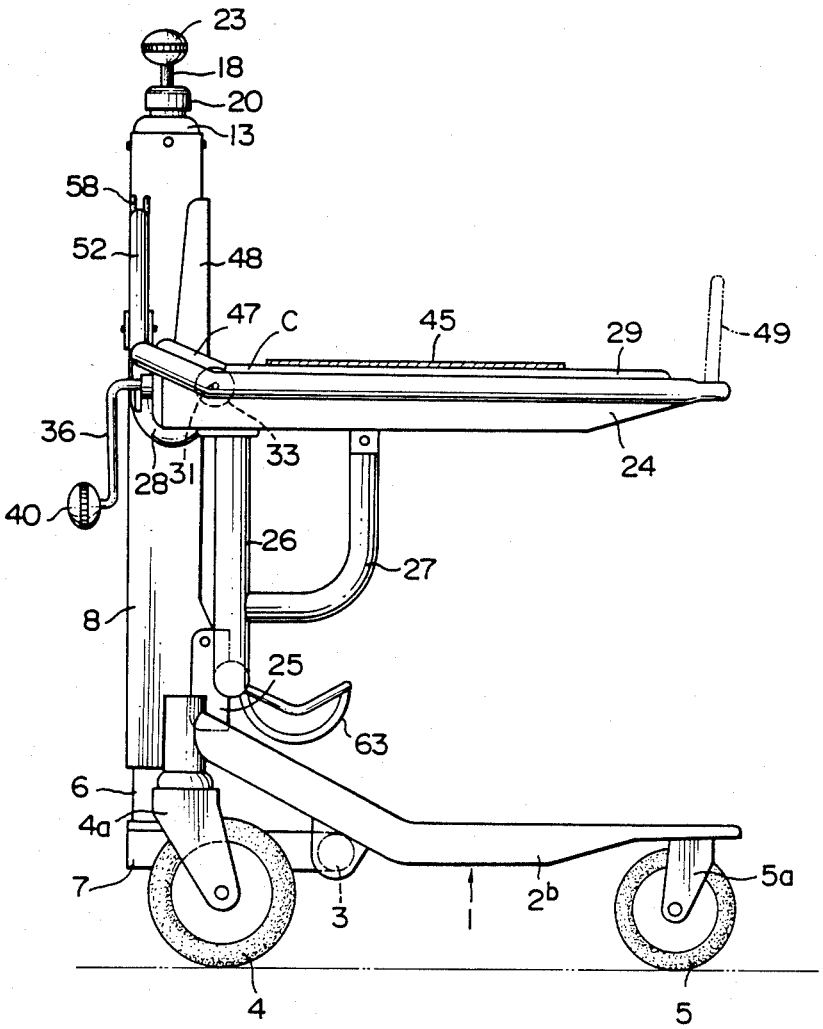
FIG. 1 is a front view of an embodiment of a movable bed vehicle according to the present invention.

In a truck 1, front and rear frames 2*a* and 2*b* which are inclined to lower from left side to right side as a reference of a front view in FIG. 1 are connected via a lateral frame 3 arranged longitudinally in a U-shaped state. Rolling wheels 4, 4 and 5, 5 are mounted through forks 4*a* and 4*b* which are rotatable around a longitudinal axis at the left and right ends of the frames 2*a* and 2*b*. In this case, the truck 1 is defined in size such as in height to be able to be freely telescoped underneath a bed to be described later. Since the vehicle 1 has casters as described above, the vehicle 1 can be moved in all directions freely by pushing, and it is preferred to add suitable stop means to stop the unintentional rotation at the wheels 4 and 4.

A base frame 7 is protruded horizontally leftwardly from the lateral frame 3 of the truck 1 from the longitudinal center in FIG. 1, and a post 6 of cylindrical shape is stood slightly left side of the end of the frame 7 and hence the wheels 4, 4.

Figure 6:
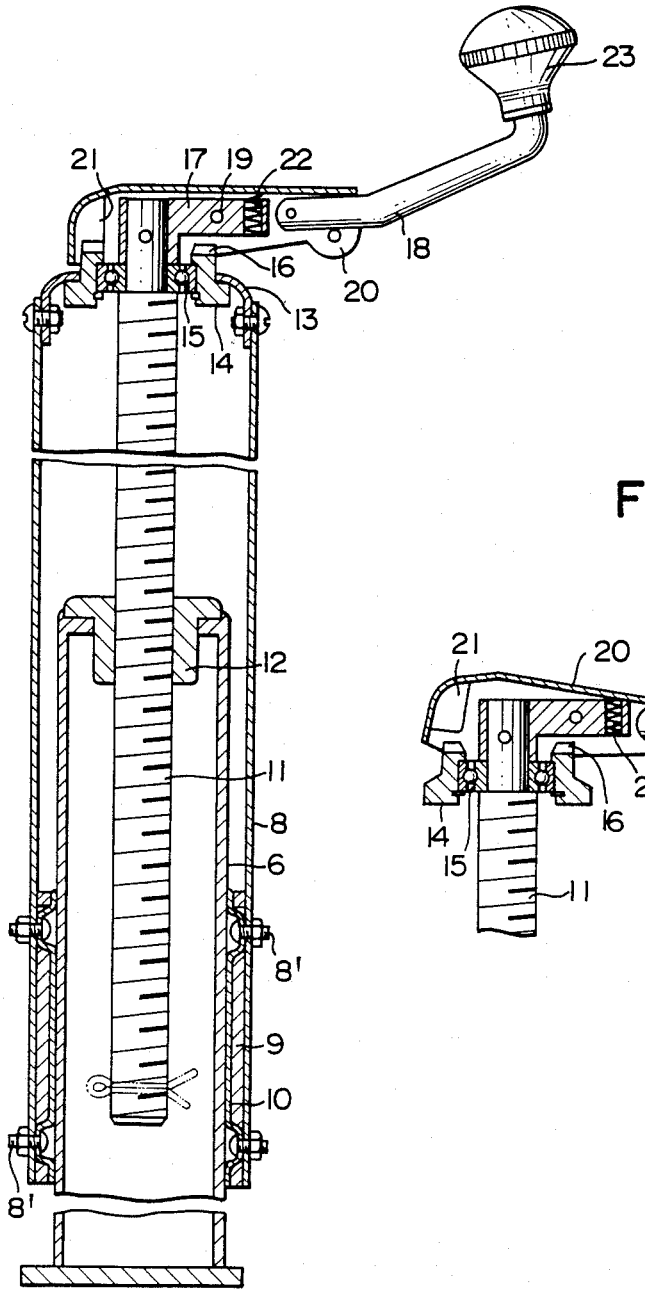
FIG. 6 is a front longitudinal sectional view of the elevator section.

An elevator 8 of cylindrical shape is engaged through a reinforcing plate 9 which is clamped with screws 8', 8' and a synthetic resin plate 10 made of Teflon as shown in FIG. 6 with the outer peripheral side of the post 6.

As clearly shown in FIG. 6, a threaded shaft 11 is engaged through a nut 12 which is mounted at the upper end of the pot 6, and journaled through a bearing 15 to a metal 14 which is mounted through a bracket 13 at the upper end of the elevator 8. Reference numeral 16 designates a clamping pawl which is provided at the upper outer periphery of the metal 14.

Figure 7:
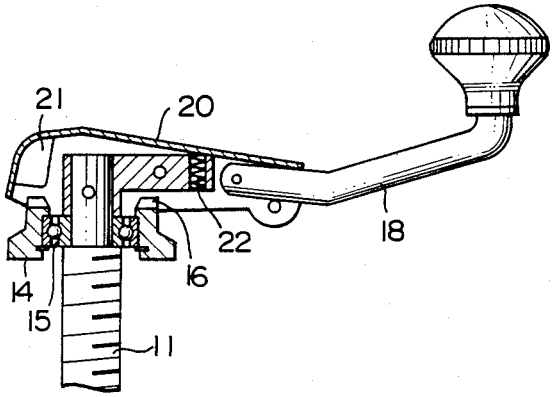
FIG. 7 is a sectional view of the bed vehicle in the handle operating state at the upper part in FIG. 6.

Reference numeral 17 indicates a lever which is engaged with a pin to the upper end of the shaft 11, reference numeral 18 indicates a rotary handle which is clamped via fittings 20 pivotally secured elevationally with a pin 19 to the lever 17, reference numeral 21 indicates a connector which is provided on the inner surface of the fittings 20, reference numeral 22 indicates a spring which is interposed between the fittings 20 and the lever 17 for always urging the fitting 20 upwardly. As shown in FIG. 7, when the handle 18 is pressed against the tension of the spring 22, the connector 21 is disconnected from the pawl 16, thereby allowing the handle 18 to rotate the shaft 11. Reference numeral 23 depicts a grip which is rotatably mounted to the end of the handle 18.

Figure 2:
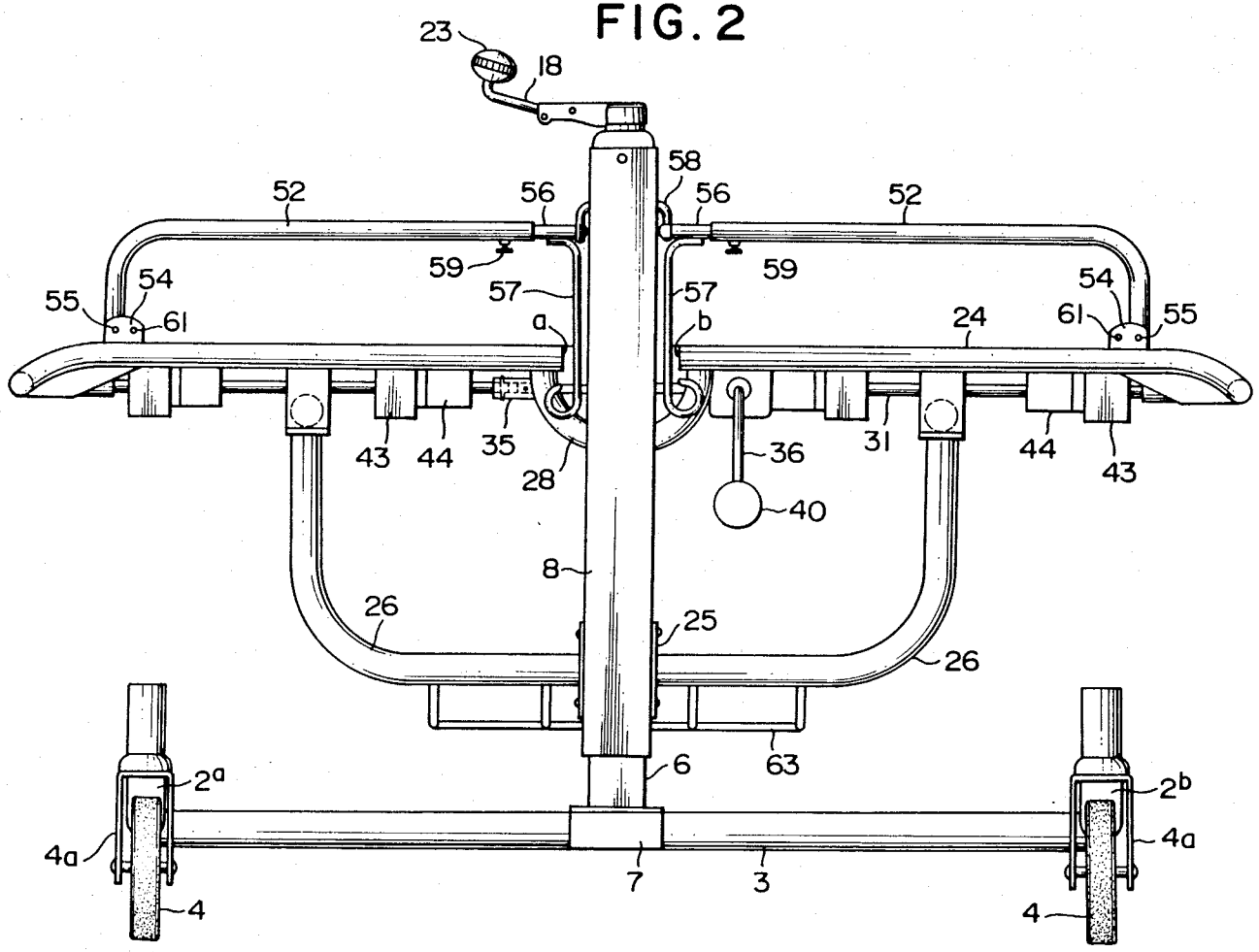
FIG. 2 is a left side view of the bed vehicle partly simplified.

Reference numeral 24 designates a bed frame, which is formed as shown in FIGS. 1 and 2, in a planar outer periphery supported by a frame 26 mounted through a bracket 25 on the elevator 8 and a branch frame 27 integral with the frame 26 in a rectangular shape in such a manner that the outer periphery is formed of piped framework. The right end of the pipe in a lateral direction in FIG. 1 is elevationally pressed in a reduced thickness. Reference numeral 28 indicates a coupling frame, which couples the edges a and b at the outer periphery of the frame 24 at the left side in FIG. 1, which edges a and b finish at the position opposite to the front and rear wall surfaces of the elevator 8, and are thus formed in U shape for coupling around the right side of the elevator 8 in FIG. 1.

The bed frame 24 is formed longitudinally in long shape in FIG. 1 in such a manner that the longitudinal intermediate portion thereof is formed in a recess shape with the frame 28 at the left side face as seen planarly, the elevator 8 is engaged with the recess, and the left end of the elevator 8 is largely projected from the left end of the frame 24.

Figure 3:
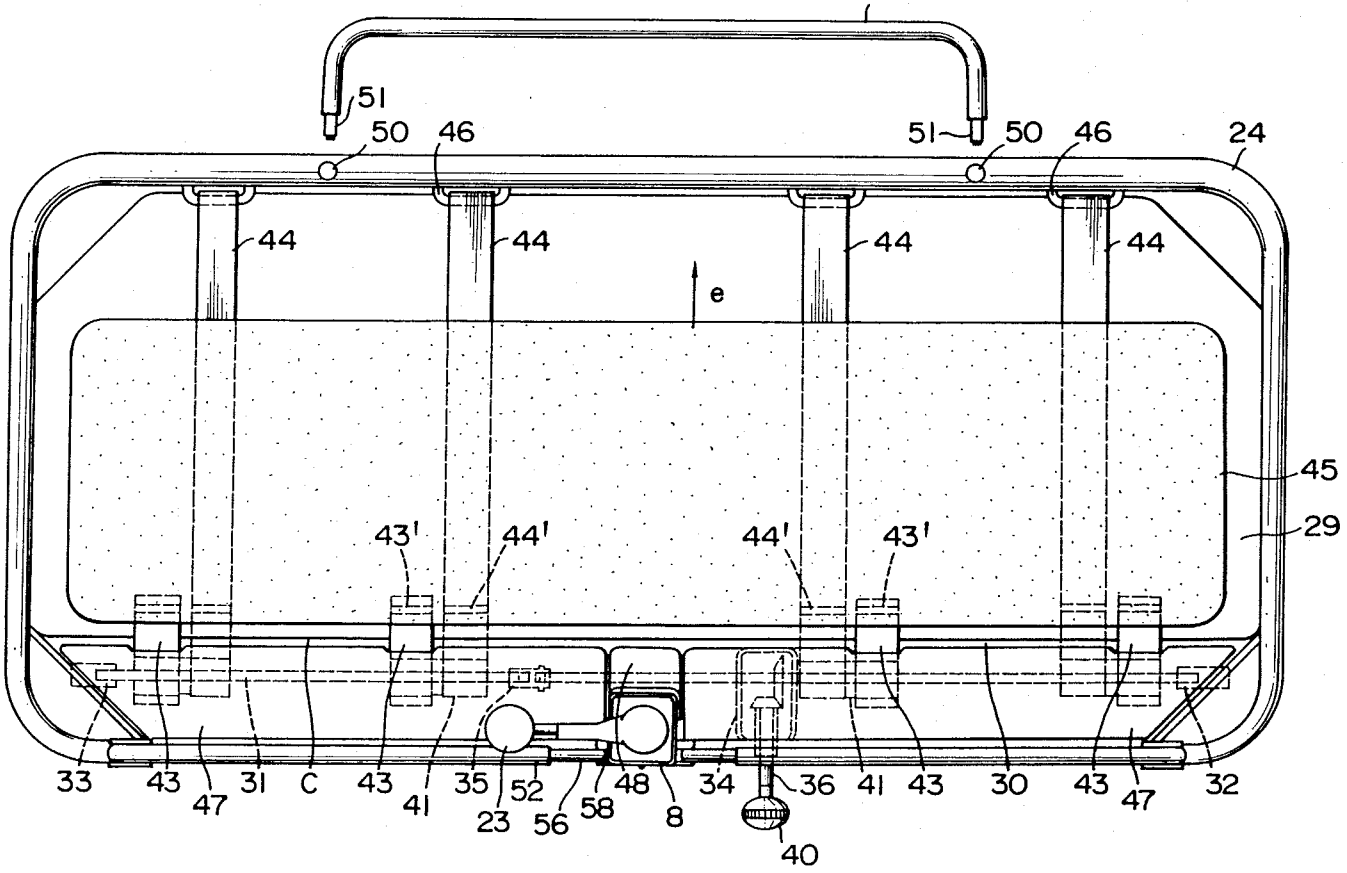
FIG. 3 is a plan view of the bed vehicle.

Reference numeral illustrates a bed mattress, which is constructed by enclosing the periphery of a cushion material with a synthetic cloth, supported to the inside of the frame 24, and a space 30 is formed between the left edge c of the mattress 29 in FIG. 3 and the left end inner surface of the frame 24.

Reference numeral 31 designates a rotational shaft, which is rotatably supported through metals 32, 33, 34 to the bed frame 24 in the space 30. Reference numeral 35 indicates a universal joint.

Reference numeral 36 depicts a handle, in which a base formed in L shape is journaled by a metal 37 provided at the lower left end of the frame 24, a set of bevel gears 38 and 39 are interposed between the metal 37 and the shaft 31 to normally or reversely rotate the shaft 31 by the operation of the handle 36. Reference numeral 40 illustrates a grip.

Reference numerals 41, 41 designate strip takeup rolls, which are wedged to the shaft 31, and connectors 42, 42 are integrally mounted on the peripheral surface thereof.

Reference numerals 43 and 44 designate strips (which may be strings), which suture the base ends in a ring shape, which is inserted into the connectors 42 and 42 of the rolls 41 and 41. When the shaft 31 normally rotates, the strip 43 is taken up, while when the shaft 31 reversely rotates, the strip 44 is taken up.

Reference numeral 45 designates a movable sheet, which is formed of a bendable synthetic resin, rubber or cloth with slightly thick strong sheet and laid on the upper surface of the mattress 29. The end of the strip 43 is sewed with a yarn 43' in FIG. 3 on the left side back surface of the sheet 45 in FIG. 1, and the other strip 44 is extended from the rolls 41, 41 through the back side of the mattress 29 into strip bobbins 46, 46 which are mounted on the left end inner surface of the frame 24 in FIG. 1, folded thereat, and secured with a yarn 44' to the sheet 45 at the end through the back side of the sheet 45.

Figure 8:
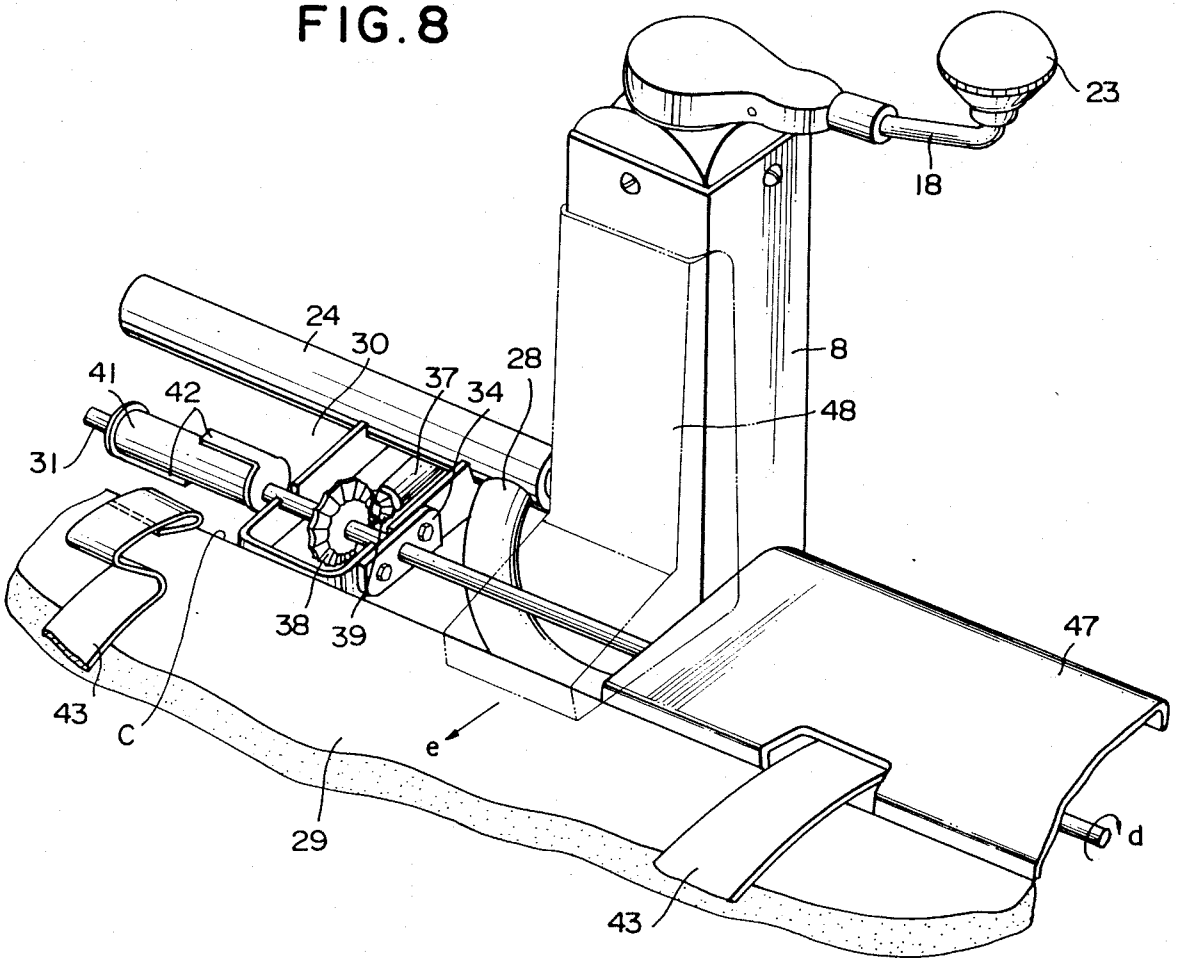
FIG. 8 is a perspective view showing the vicinity of the elevator.

Accordingly, when the shaft 31 is rotated in a normal direction d as shown in FIG. 8, the strip is taken up, while the strip 44 is rewound, thereby allowing the sheet 45 to be towed and moved to the left side in FIG. 1 on the mattress 29 as shown in FIG. 3. When the shaft 31 is reversely rotated, the strip 44 is taken up, while the strip 43 is rewound, thereby allowing the sheet 45 to be moved in a direction of an arrow e to largely extend to the left side outward direction of the mattress 29.

Reference numerals 47 and 47 indicate auxiliary retainers which cover the space 30 on the shaft 31 and which are formed of cloth or synthetic film bonded onto the upper surface of the frame formed of an iron plate or synthetic resin, and detachably mounted on the bend frame 24. In the embodiment, retainers are divided longitudinally into two segments at the boundary of the elevator 8.

Reference numeral 48 designates a cover, which is disposed between the retainers 47 and 47 for shielding the upper inside of the elevator 8 and blocking the space 30.

Reference numeral 49 indicates a right side drop preventing frame, which is formed of iron pipes in a gate shape and detachably engaged via pins 51 and 51 at the end of the frame 49 through holes 50 and 50 which are perforated at the frame 24 at the left side in FIG. 1.

The holes 50, 50 are formed in such a manner slightly displaced from the axes of the pins 51, 51 so that both pins 51 and 51 are not simultaneously removed when the longitudinal center of the frame 49 is grasped but are removed always when pulled from one end side at the relative position of the pins 51 and the holes 50.

Figure 4:
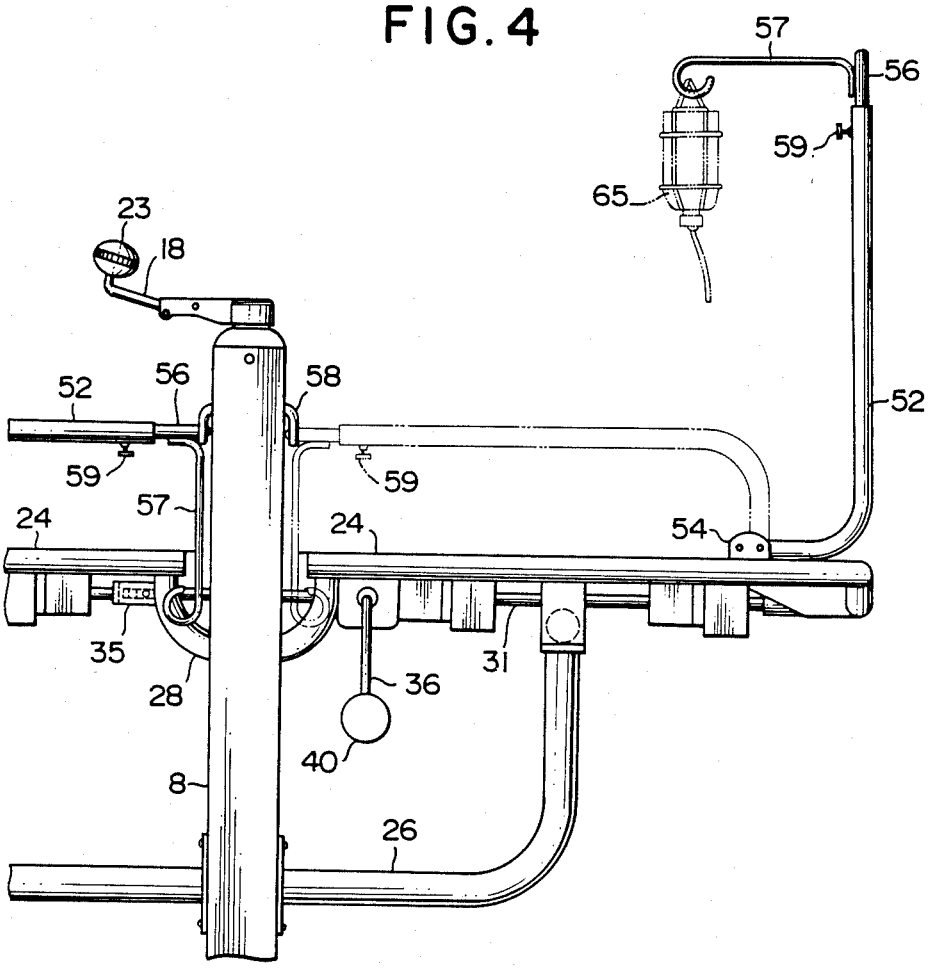
FIG. 4 is a left side view of the essential part illustrating the operation state.
Figure 5:
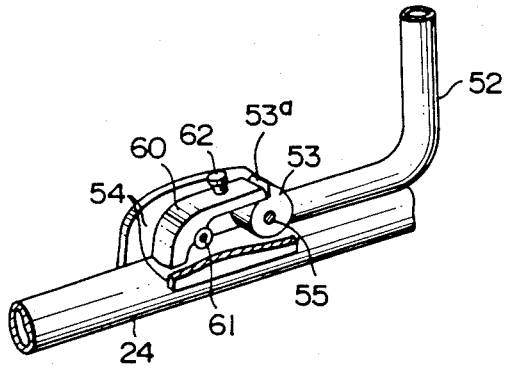
FIG. 5 is a perspective view of the bed vehicle partly broken away at the essential part in FIG. 4.

Then, reference numerals 52 and 52 illustrate left side drop preventing frames, in which eccentric cams 53 are integrally secured to the base of the pipe 52*a* bent in L shape as seen from the side in FIGS. 2, 4 and 5, the cam 53 is rotatably mounted at the center thereof via a pin 55 on a bracket 54 mounted on the left end of the frame 24, a rotatable shaft rod 56 is mounted on the end side of the pipe 52*a*, and a hook 57 capable of hanging an instillation bottle from the rod 56 is integrally mounted. Reference numeral 58 designates a connector, which is fixed to the longitudinal side surface of the elevator 8 in FIG. 1, the rod 56 is engaged from above with the connector 58 for preventing the lateral fluctuations. Reference numeral 59 designates a stopper for the removal of the rod 56 and set bolt for preventing the rod 56 from turning.

Reference numeral 60 illustrates a clamping pawl, which is rotatably mounted via a pin 61 to the bracket 54, the end of which is slidably contacted by its own weight onto the outer upper peripheral surface of the cam 53, the pawl 60 is introduced into the step 53*a* of the cam 53 in engagement with the cam by turning and erecting the frame 52, thereby preventing the frame 52 from reciprocating and overturning, and reference numeral 62 indicates a clamping pawl lifting knob, and when the knob 62 is pulled down, the frame 52 can be reciprocated. Reference numeral 63 designates an oxygen bomb container in FIGS. 1 and 2.

Figure 9:
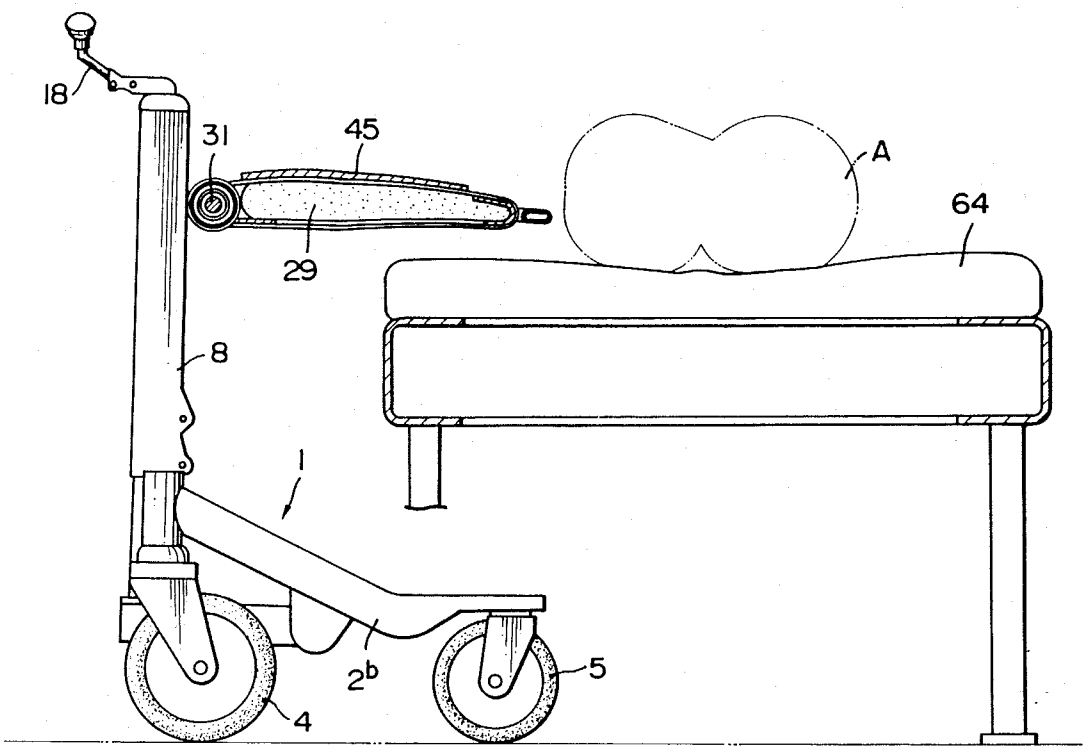
FIG. 9, 10, 11 and 12 are schematic front views for describing the operating sequence of the bed vehicle.

The operation of the movable bed vehicle thus constructed as mentioned above will be described. The movable bed vehicle is first moved to the side of a bed 64, on which a physically handicapped patient or person A is laid on as shown in FIG. 9 in the state in FIG. 1, the handle 18 is rotated while pressing as shown in FIG. 7 to rotate the shaft 11, thereby moving downwardly the elevator 8, the mattress 29 is thus lowered to contact the bed frame 24 on the bed 64.

Figure 10:
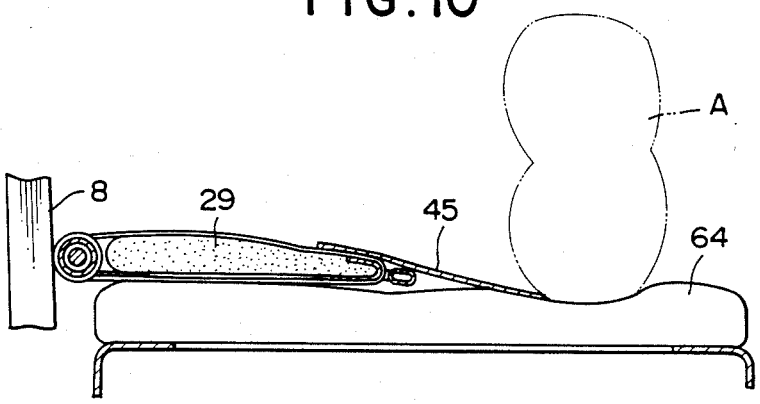

Then, the mattress 29 is pressed to the right side of the bed 64 the patient A while shifting the patient's position on the bed as shown in FIG. 10 in side sleeping state, the handle 36 is operated in this state to rotate reversely the shaft 31 in the opposite direction of an arrow d. Then, the sheet 45 slides and extends from above the mattress 29 as shown in FIG. 10 and is disposed on the bed 64 at the back side of the patient A.

In this case, the sheet 45 is moved in advance rightwardly of the mattress 29, and the sheet may be inserted into the back side simultaneously when the patient A is shifted at its sleeping position.

Figure 11:
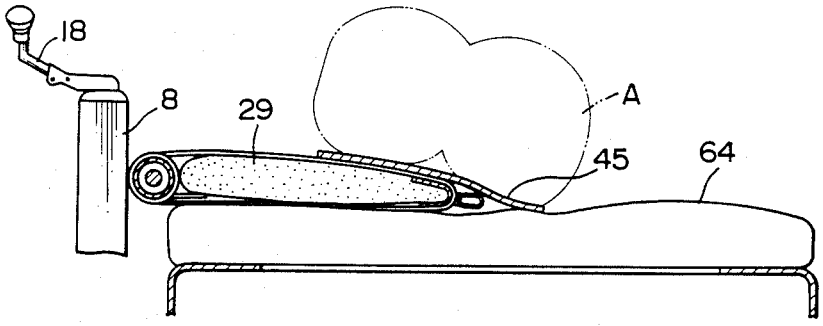

In any case, the patient A is slowly laid on the sheet 45 after disposed in the state in FIG. 10, thereby allowing the patient A to face upward on the bed, the shaft 31 is rotated by the handle 36 in the direction of the arrow d, the sheet 45 is moved leftwardly as in FIG. 11 and moved onto the mattress 29.

Figure 12:
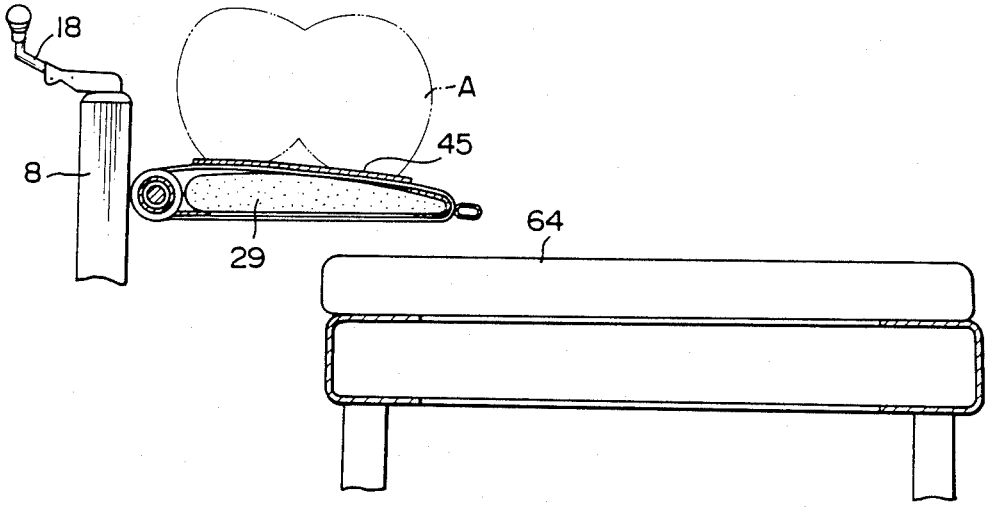

Then, the handle 18 is rotated to move upward the frame 24 through the elevator 8, and the vehicle is moved as in FIG. 12, thereby moving the patient A freely to the object place.

It is noted that, when the patient A is shifted onto the bed vehicle, the frame 49 is removed, and mounted after the patient is shifted.

When an instillation is carried out to the patient A, the frame 52 of front or rear side is erected at the solid line position in FIG. 4, and the hook 57 is engaged with the end of the frame 24 at this time so as not to erect as it is. Accordingly, the set bolt 59 is loosened, and it is preferable that the frame 52 is erected while rotating the rod 56 to the right side. When erected as in FIG. 5 as described above, the pawl 60 is engaged with the step 53*a* of the cam 53, so that the frame 52 may no longer overturn.

The hook 57 is rotated to the suitable position, set, and a medicine bottle 65 may be hung from the hook 57.

In this manner, the patient who is laid on the mattress 29 and moved is disposed at the position in the vicinity of the elevator 8 which can elevationally move as supported by the post 6 mounted on the bed vehicle 1, and the left side space 30 of the mattress 29 is covered with the retainers 47, 47. Accordingly, the hands and legs of the patient A are not fallen into the space 20, and the bed vehicle can be approached to the elevator 8 side nearer with safety, and the frame 24 can stably support the body weight of the patient A in this manner.

Then, in order to again return the patient A laid on the mattress 29 to the bed 64, the mattress 29 is contacted with the upper surface of the bed 64 as shown in FIG. 11, the shaft 31 is reversely rotated by the handle 36, the strip 44 is taken up by the roll 41, thereby pulling out the sheet 45 onto the bed 64, the patient A is disposed in the state as in FIG. 10, moved on the mattress 29, further removed from the upper surface of the bed 64, and shifted to face upward from the side sleeping position as the original state as shown in FIG. 9.

Since first embodiment of the present invention comprises, as concretely exemplified in the above-described embodiments, a truck 1 having rolling wheels 4, 4 and 5, 5 with low centroid, a post 6 erected at the longitudinal intermediate position at one side of lateral direction of the vehicle, an elevator 8 provided adjustably at the post 6 in such an elevationally movable manner, a bed frame 24 having a longitudinal length at the elevator 8 and a bend mattress 29, and mounted directly above the truck 1, a normally and reverely rotatably rotational shaft 31 provided along longitudinal direction of the bed frame 24 for rotating by a handle the bed frame 24 in a space 30 of elevator 8 side, a plurality of strips 43 provided at a plurality of longitudinal positions of the shaft 31 for towing the movable sheet on the mattress 29 to the elevator side by normally taking up the strips, and another strips 44 for towing the movable sheet 45 until the elevator 8 is extended to the opposite side from the mattress 29 by the reverse rotation, the physically handicapped patient A who cannot move on the bed 64 can be shifted at his sleeping position by one nurse or attendant, shifted on the bed mattress 29 of the movable bed vehicle merely by operating the handle in an extremely simple and rapid work. Since the bed frame 24 is disposed directly above the truck 1, the movable bed vehicle can be sufficiently approached to the bed 64 with ready operation, and even if the load of the patient A is applied, the stable bed vehicle can be provided.

Since the second embodiment of the present invention further comprises, in addition to the constitution in the first embodiment, said elevator 8 disposed directly above the bed frame 24 to intrude into the inside of the bed frame 24 for forming a space 30 at the elevator 8 side of the bed frame 24 and auxiliary retainers 47 and 47 provided to cover the rotational shaft 31 in the space 30, the patient A is not engaged at his clothing, even if the patient A is sufficiently displaced to the elevator 8 side on the bed mattress 19, by the shaft 31 and the members attached thereto. Accordingly, the movable bed vehicle can improve high stability, though constructed in a cantilever structure, and can be finished with light weight.

Since in the second embodiment of the present invention the strips 43 which is sewed to the movable sheet capable of towing toward the normal rotation side is provided at the strip takeup rolls 41, 41 formed at a plurality of positions takeup rolls 41, 41 formed at a plurality of positions longitudinally of the shaft 31 and the strips 44 which are secured to the movable sheet 45 capable of towing the sheet 45 from the bed mattress 29 to the opposite side of the elevator 8 until extended to be taken up by the reverse rotation and are arranged at the lower position of the bed mattress 29 is wound on the strip bobbins 46, 46 provided at opposite side to the elevator 8 of the bend frame 24 at the strip takeup rolls 41, 41, the movable sheet can be effectively reciprocated in a predetermined direction by the simple operation of the handle inexpensively.

What is claimed is:

1. A movable bed vehicle comprising a truck having rolling wheels with low centroid, a post erected at the longitudinal intermediate position at one side of lateral direction of said vehicle, an elevator provided adjustably at said post in such an elevationally movable manner, a bed frame having a longitudinal length at said elevator and a bed mattress and mounted directly above said truck, a normally and reversely rotatably rotational shaft provided along longitudinal direction of the bed frame and rotating by a handle in a space at the elevator side of said bed frame, a plurality of strips provided at a plurality of longitudinal positions of the shaft for towing a movable sheet on said mattress to said elevator side by normally taking up said strips, and another strips for towing the movable sheet until said elevator is extended to the opposite side from said mattress by the reverse rotation.

2. A movable bed vehicle comprising a truck having rolling wheels with low centroid, a post erected at the longitudinal intermediate position at one side of lateral direction of said vehicle, an elevator provided adjustably at said post in such an elevationally movable manner, a bed frame having a longitudinal length at said elevator and a bed mattress and mounted directly above said truck in such a manner that said elevator is intruded into the inside of said frame, thereby forming a space at the elevator side of said bed frame, a normally and reversely rotatably rotational shaft provided along longitudinal direction of the bed frame and rotating by a handle in the space, a plurality of strips provided longitudinally of said frame and secured to said sheet capable of towing a movable sheet on said mattress to said elevator side by normally taking up said strips at strip takeup rolls provided at a plurality of positions longitudinally of said rotational shaft, another strips provided on said strip takeup rolls, secured to the movable sheet and wound with the strips engaged with a strip bobbins provided at the opposite side to said elevator of said bed frame and arranged at the lower position of said bed mattress to enable to tow the movable sheet until said elevator is extended to the opposite side from said mattress by the reverse rotation, and auxiliary retainers provided in the space for covering the rotational shaft.

* * * * *